US006473446B2

(12) United States Patent
Stercho

(10) Patent No.: US 6,473,446 B2
(45) Date of Patent: Oct. 29, 2002

(54) ELECTRIC FURNACE FOR STEEL MAKING

(75) Inventor: Michael J. Stercho, Wexford, PA (US)

(73) Assignee: SMS Demag, Inc., Pittsburgh, PA (US)

( * ) Notice: Subject to any disclaimer, the term of this patent is extended or adjusted under 35 U.S.C. 154(b) by 0 days.

(21) Appl. No.: 09/737,440

(22) Filed: Dec. 13, 2000

(65) Prior Publication Data

US 2002/0071473 A1 Jun. 13, 2002

(51) Int. Cl.[7] ..... F27D 23/00; F27D 3/00
(52) U.S. Cl. ..... 373/78; 373/72; 373/79
(58) Field of Search ..... 373/71, 72, 73, 373/74, 75, 76, 77, 78, 79, 81, 83, 84; 266/44, 196, 200, 236; 75/10.12

(56) References Cited

U.S. PATENT DOCUMENTS 3,767,090 A * 10/1973 Sundberg et al. ..... 373/79
4,423,514 A * 12/1983 Davene ..... 373/79
4,523,747 A * 6/1985 Schnitzer et al. ..... 266/44
4,552,343 A * 11/1985 Labate et al. ..... 266/200

* cited by examiner

*Primary Examiner*—Tu Ba Hoang
(74) *Attorney, Agent, or Firm*—Clifford A. Poff

(57) ABSTRACT

An electric furnace includes a stationary lower shell having a sloping floor extending downwardly to a tap hole to always maintain a sufficient ferrostatic head three times the tap hole for slag free tapping. The configuration of the refractory for containing a heat, is sufficient to maintain a liquid metal heel of at least 70% of the heat before tapping for maintaining flat bath operation during refining a steel melt. An upper furnace shell is supported on the lower furnace shell and a furnace roof is supported by the upper furnace shell. The entire furnace is mounted on a furnace transfer car that is anchored for stationary operation but moved to a furnace exchange position for servicing any of the components making up the furnace. The furnace roof and/or upper furnace shell may be supported at a furnace operate position while the lower furnace shell is transported to the furnace exchange position.

23 Claims, 13 Drawing Sheets

CYCLE TIME COMPARISON

STANDARD TILTING EAF vs NON-TILTING EAF w/SCRAP CHARGER

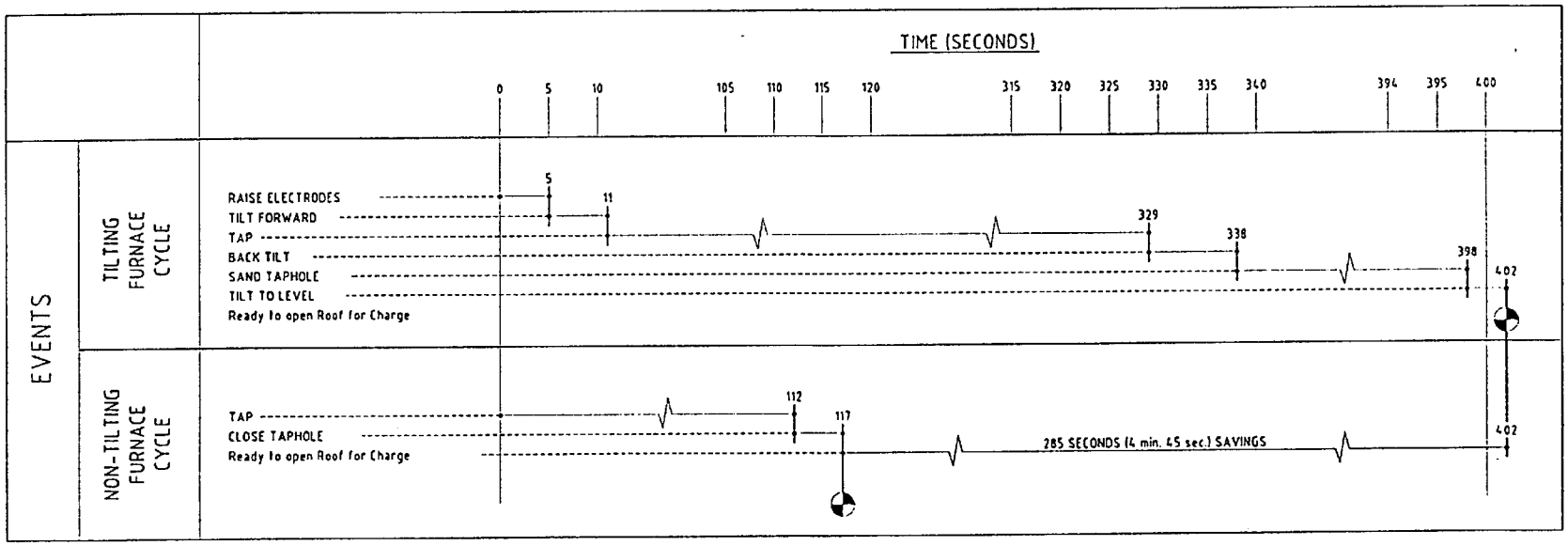

STUDY BASED ON 180ST TAP SIZE FURNACE

| | TILTING | NON-TILTING |
|---|---|---|
| TAP HOLE SIZE | 6" NEW | 9" NEW |
| HEIGHT AT START OF TAP | 49" | 75" |
| HEIGHT AT END OF TAP | 21" | 36" |
| EXCESS HEIGHT ABOVE (DEPTH EQUAL TO 3 DIAMETERS OF TAP HOLE) | 3" | 9" |

NOTE:
1. SLAG-FREE TAPPING CRITERIA BASED ON MINIMUM HEIGHT ABOVE TAPHOLE OF 3x THE TAPHOLE DIAMETER.
2. WITH 33% INCREASE IN TAPHOLE DIAMETER DUE TO WEAR, DEPTH OVER TAPHOLE FOR NON-TILTING FURNACE IS STILL 3x THE TAPHOLE DIAMETER.

TAPPING CYCLE COMPARISON

STANDARD TILTING EAF vs NON-TILTING EAF

FIGURE 17

ELECTRIC FURNACE FOR STEEL MAKING

CROSS REFERENCE TO RELATED APPLICATION

Not applicable.

BACKGROUND OF THE INVENTION

1. Field of the Invention

The present invention relates to a steel making furnace using electrical current as a heat source and, more particularly, to such a furnace designed and constructed to remain statically positioned through consecutive furnace cycles each cycle being characterized by always maintaining a sufficient large wet heel for flat bath operation through charging and slag free tapping.

2. Description of the Prior Art

It is known in the art of steel making to use electric current as a heat source in a steel making furnace. Arc heating furnaces are used to heat a metal charge by either heat radiation from arcs passed between electrodes above the metal charge or by arcs passing from the electrodes to the metal charge where heat is generated by the electrical resistance of the metal charge. When the furnace has an electrically conductive furnace bottom, the bottom forms part of an electrical circuit powered by direct current. When the furnace has a non-conductive furnace bottom, the electrical circuit is powered by alternating current and the circuit is limited to the electrodes and metal charge. Induction furnaces are also used to heat a metal charge by using either inductors according to a transformer principle where the secondary winding is formed by a loop of liquid metal in a refractory channel or a coreless principle where induction coils surround the furnace wall and generate a magnetic field to impart energy to the metal charge in the furnace.

The present invention is applicable to such electric furnaces and in particular to an alternating current direct arc electric furnace equipped with three electrodes powered by three phase alternating current to establish arcs passed from an electrode to a metal charge to another electrode and from electrode to electrode. The direct-arc electric-furnace as used in the steel industry is primarily a scrap-melting furnace, although molten blast-furnace iron and direct-reduction iron (DRI) are also used for charging the furnace. Combinations of scrap and minor quantities of blast furnace iron or direct reduction iron are common furnace charging compositions. A three-phase transformer, equipped for varying the secondary voltage, is used to supply electrical energy at suitable range of power levels and voltages. Cylindrical solid graphite electrodes are suspended by a mechanism from above the furnace downwardly through ports in a furnace roof to positions so that the electrodes conduct the electric current inside the furnace to maintain arcs for melting and refining a furnace charge. A side wall supports the roof on a lower shell which is provided with a refractory lining to contain the metal charge. The lower shell is pivotally support on a foundation and a furnace tilting drive is operated to tilt the furnace in each of opposite directions for de-slagging and tapping. Other drive mechanisms are provided to remove the roof from the upper shell to gain access to the furnace interior for the introduction of a metal charge.

The tonnage of liquid metal that can be refined in such tilting furnaces is limited by the load bearing capacity of the pivotal support and the furnace tilting drive and the practical limits of the geometry of the hearth. The pivotal support and the tilting drive must take the form of robust structures to sustain and pivot the weight of the entire furnace and its content of liquid steel and slag. The geometry of the hearth when tilting the furnace to tap steel and to clear the tap gate for sand cleaning of the tap hole adds stresses to the pivotal support and tilting drive that increase significantly with an increase to the furnace tilt angle. The tilting of the furnace must be sufficiently slow and carefully controlled to avoid erratic eccentric loading on the tilting mechanism due to the wave like shock loading as the liquid steel shifts back and forth in the volume of the hearth of the furnace. The drive mechanism and support structure to tilt the electric furnace represents a significant capital expenditure. Costs are also incurred by the required maintenance to prevent a serious consequence should the tilt structure fail to allow draining of the heat from a furnace. The practical limits of the geometry of a tilting furnace hearth limit the depth of steel above the tap hole and therefore limit the maximum diameter of the tap hole that can be used and still have slag free tapping. This small size tap hole results in longer tapping times. Draining most of the steel from the furnace prolongs the time between tapping of the furnace because of the need to reestablish a liquid metal bath using significant quantities of electric power for the heating the metal charge. It is known in the art to retain a quantity of the steel in the furnace after tapping which is commonly called a wet heel practice. However, the structural integrity of the furnace mandates that the slag line be inspected periodically, typically every three to twelves heats with repairs performed based on the slag line condition. Generally, gunning will be performed several times a week. Periodically, every two-three weeks, the complete furnace bottom will be exchanged with a newly rebuilt bottom and worn bottom will have its side walls in the slag line area undergo a major repair.

Accordingly, it is an object of the present invention to provide an electric furnace suitable for use in a green field installation, to revamp existing installations to form a steel making facility for supply of ladles of steel at temperatures and tonnages significantly greater than provided by known electrically heated furnaces.

It is another object of the present invention relates to a steel making method and furnace construction to improve electric furnace operating efficiency and steel making capacity of an electric furnace.

It is a further object of the present invention to provide a versatile electric furnace design to simplify furnace maintenance and to maintain a large liquid metal hot heel for promoting flat bath operation and slag free tapping of a heat.

BRIEF SUMMARY OF THE INVENTION

According to the present invention there is provided an electric furnace for steel making, the furnace including the combination of a lower furnace shell stationarily supported during charging, heating and tapping of a heat, the lower shell having a floor wall with a sloping contour to increase a liquid metal depth of a heat to at least three times the diameter of a tap hole at a site communicating with the tap hole for slag free tapping of a heat, the lower furnace shell having a liquid metal capacity to maintain a liquid metal heel of at least 70% of a heat before tapping for flat bath refining of a heat throughout the charging and heating of a heat, an upper furnace shell supported by the lower furnace shell, a furnace roof supported by the upper furnace shell, an electrically powered member for heating a metal charge in the lower furnace shell, and a control including plugging for the tap hole to control tapping of a heat form the lower furnace shell. A lower shell stationarily supported during furnace operations consisting of charging, heating and tapping of a heat, the lower shell having a floor with a sloping contour to increase liquid metal depth at a site communicating with a tap hole for tapping of a heat, an upper shell supported by the lower shell, a roof supported by the upper shell, the roof including at least one aperture for passage of an electrode to heat a metal charge in the lower, shell, an electrode positioned by electrode carrier arm relative to the aperture for heating a metal charge in the lower shell, and a plug member operatively associated with the tap hole for maintaining a liquid hot heel in the lower shell after tapping of a heat.

Accordingly, the present invention also provides a method for producing steel in an electric furnace, the method of including the steps of providing an electric furnace including a furnace shell having a sloping floor extending downwardly to a tap hole refining a steel melt in the furnace using electric current to form a first heat, tapping a sufficient quantity of steel from the first heat to a ladle while the lower shell remains stationary to maintain a liquid hot heel in the furnace consisting of at least 70% of the tapped steel, maintaining flat bath furnace operation by using electric current and latent heat of the liquid hot heel to refine charged material in the furnace for forming a second heat, and tapping a sufficient quantity of steel from the second heat while the lower shell remains stationary to maintain a liquid hot heel in the furnace consisting of at least 70% of the tapped steel.

BRIEF DESCRIPTION OF THE SEVERAL VIEWS OF THE DRAWINGS

The present invention will be more fully understood when the following description is read in light of the accompanying drawings in which:

FIG. 17 is a time comparison between tapping a tilting electric arc furnace and tapping an electric arc furnace according to the present invention;

DETAILED DESCRIPTION OF THE INVENTION

Figure 1:
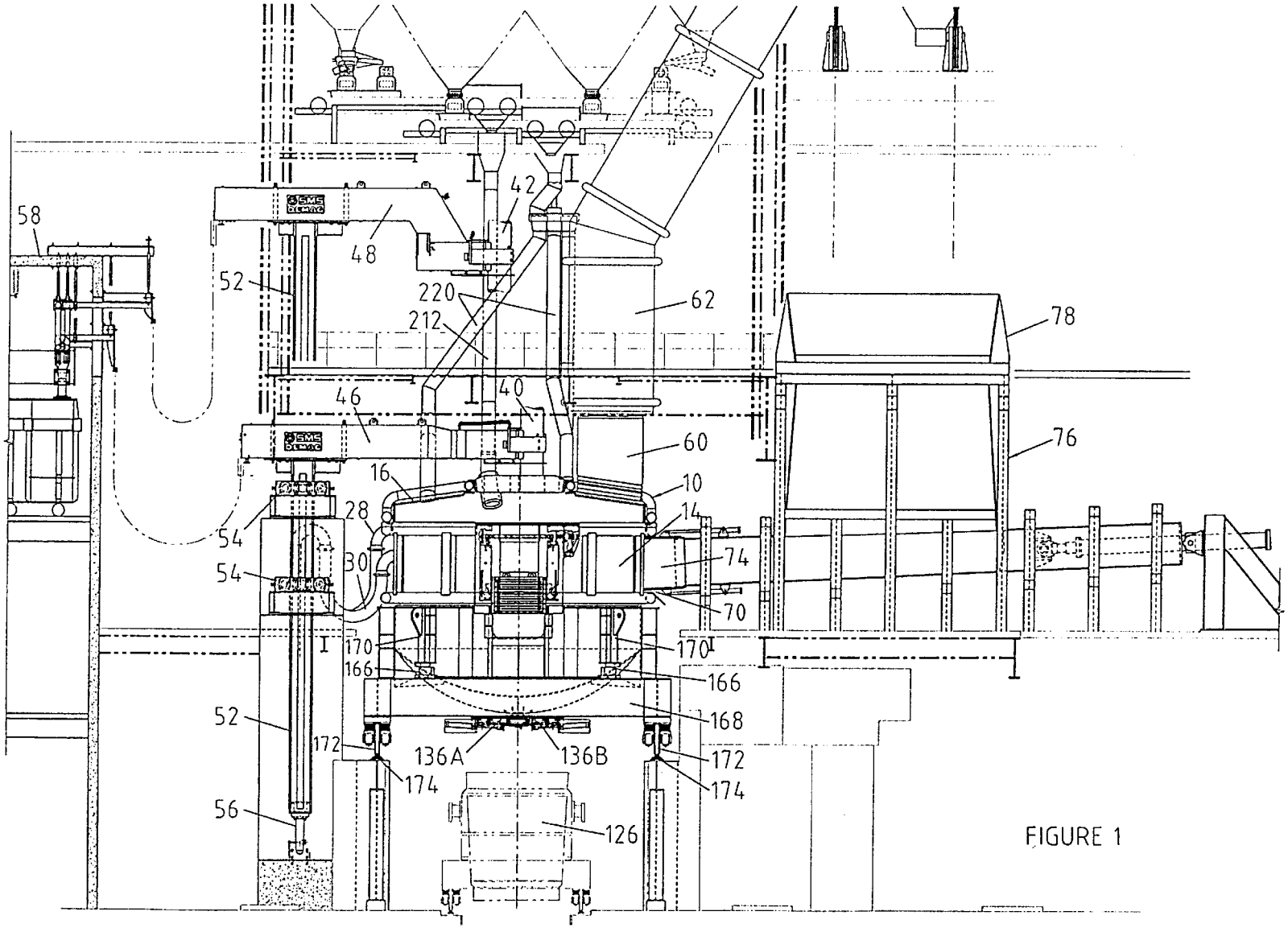
FIG. 1 is a front view of an electric arc furnace installation embodying the features of the present invention.

There is illustrated in FIGS. 1–4 a direct arc electric furnace installation embodying the features of the present invention and useful for practicing the method of the invention. The installation includes an electric arc furnace 10 formed by a lower furnace shell 12 an upper furnace shell 14 and a furnace roof 16. The furnace roof 16 includes roof panels formed by an array of side-by-side coolant pipes 20 with the coolant passageways communicating with annular upper and lower water supply headers 22 and 24, respectively, interconnected by radial distributing pipes 26 to form a water circulating system communicating with service lines 28 containing water supply and return lines. The service lines 28 include a flexible section 30 to avoid the need to disconnect the service lines 28 when it is desired to lift the furnace roof alone or combined with the upper furnace shell a short distance, e.g., 24 inches, for servicing the lower shell. The upper water supply header 22 encircles a triangular array of three apertures 32, 34 and 36 in a roof insert 38. The apertures are dimensional and arranged to accept the phase A, B and C electrodes 40, 42 and 44 and supported by electrode support arms 46, 48 and 50, respectively. Each of the electrode support arms 46, 48 and 50 is independently positioned vertically by a support post 52 restrained by horizontally spaced guides 54 in a superstructure for vertical displacement by actuator 56 typical in the form of piston and cylinder assembly. The electrode support arms 46, 48 and 50 support water cooled cables for transmission of electrical current from transformers in a transformer vault 58 to the respective phase A, B and C electrodes.

A fume duct 60 extends vertically from an annular opening in the furnace roof between the upper and lower water supply headers 22 and 24 for exhausting fumes from the interior of the furnace to an enlarged and vertically spaced duct and overlying duct 62 formed by water coolant piping to provide thermal protection. The duct 62 supplies the exhaust fume to an evaporator chamber and filter equipment, not shown, to recover pollutants.

Figure 4:
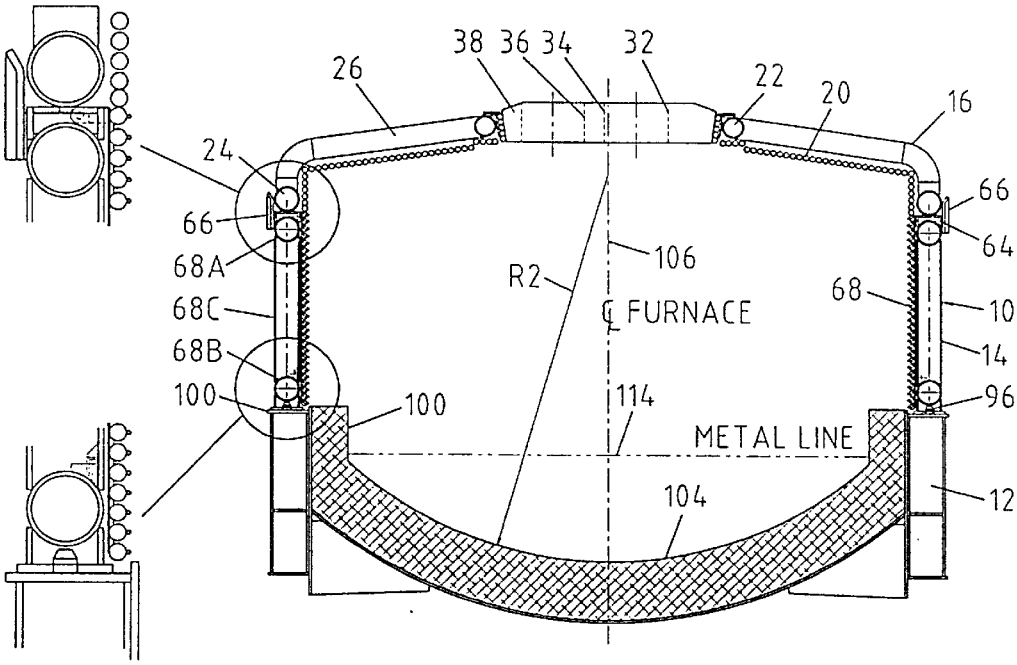
FIG. 4 is a sectional view taken along lines IV—IV of FIG. 3.
Figure 12:
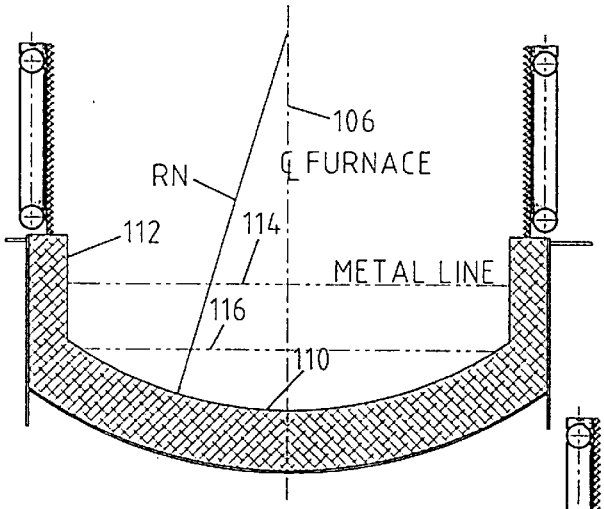
FIG. 12 is a sectional view taken along lines XII—XII of FIG. 8.
Figure 13:
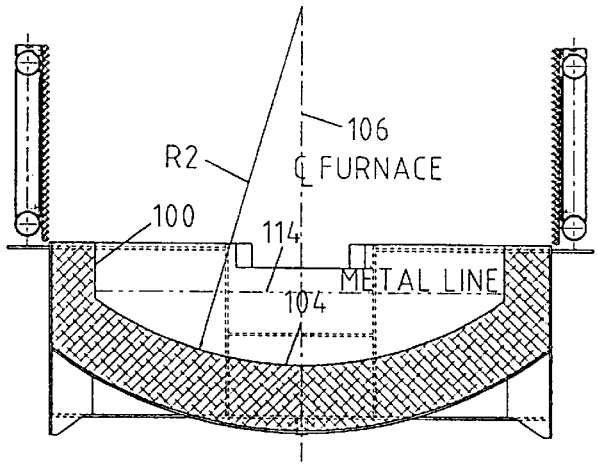
FIG. 13 is a sectional view taken along lines XIII—XIII of FIG. 8.
Figure 9:
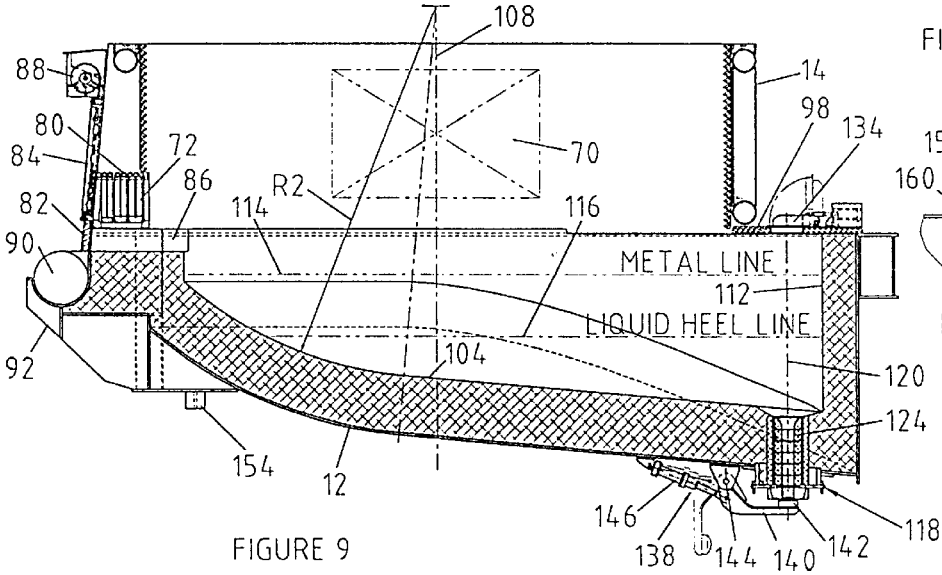
FIG. 9 is a sectional view taken along lines IX—IX of FIG. 8.

As shown in FIG. 4, the lower peripheral surface of the lower water supply header 24 of the furnace roof 16 bears on a circular ring 64 at the upper edge of the upper furnace shell 14 forming a load bearing surface to support the roof 16. Vertically extended lugs 66 at annular spaced apart intervals form lateral roof restraints for maintaining the desired superimposed relation of the furnace roof on the furnace upper shell 14. The furnace upper shell includes superimposed convolutions of coolant pipe 68 supplied with coolant from spaced apart supply headers 68A and 68B that are inter connected by vertical distribution pipes 68C to form a water circulating system communicating with service lines 68D containing water supply and return lines. Metal panels may be supported by the coolant pipe 20 of the furnace roof and the coolant pipe 68 of the furnace upper shell for confinement of the fume to the interiors of these furnace components. The service lines 68D include a flexible section 68E to avoid the need to disconnect the service lines 68D when it is desired to lift the furnace roof combined with the upper furnace shell a short distance, e.g., 24 inches, for servicing the lower shell. The convolutions of coolant pipe 68 are interrupted by a scrap charge opening 70 in one quadrant and a slag discharge opening 72 as shown in FIG. 9 in an adjacent quadrant of the annular configuration of the furnace upper shell 14. The scrap charge opening 70 is used to continuously introduce quantities of scrap at closely spaced apart intervals throughout the major portion of the furnace operating cycle and the scrap residing in a retractable chute 74 of a scrap charger 76 serves as a media to prevent unwanted escape of the fume from the furnace in the scrap charger. A bunker 78 is used in the preferred embodiment to supply scrap to the scrap charger 76. It is within the scope of the present invention to introduce scrap to the furnace chamber using alternative well known charging equipment. The slag discharge opening 72 is extended outwardly from the coolant pipe 68 boarding the slag opening by an inverted "U" shaped arrangement of barrier walls 80 formed by a serpentine arrangement of coolant pipes A slag door 82 is supported by side rails 84 mounted on the coolant pipe 68 form a movable closure for a slag discharge trough 86 in the refractory lining of the lower furnace shell 12. The slag door 82 is joined by control rods to actuator discs 88 which are rotated in a conventional manner to raise the slag door 82 and allow the discharge of slag from the furnace by trough 86 beyond a threshold formed by a carbon rod insert 90 which is supported by suitable brackets 92 on the lower furnace shell 12.

Figure 8:
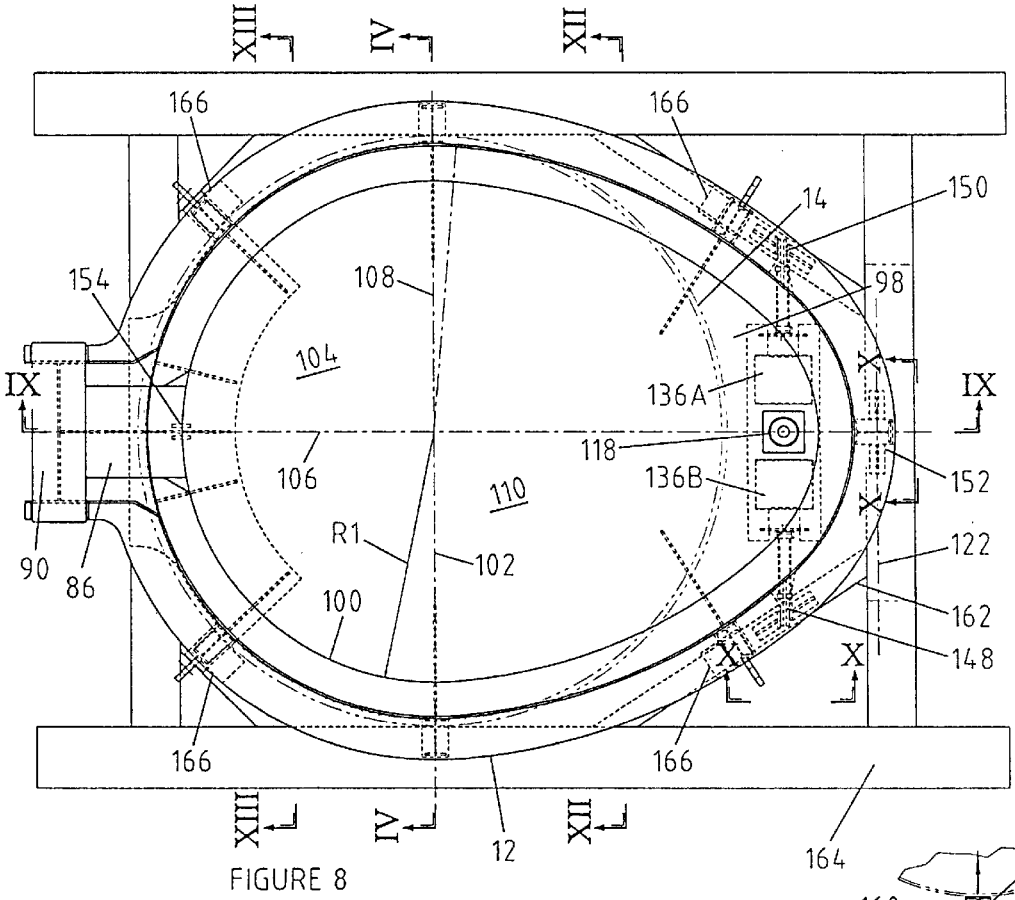
FIG. 8 is a plan view taken along lines VIII—VIII of FIG. 3.

As shown in FIGS. 4, 8 and 9, the upper furnace shell 14 include a circular ring 94 forming a lower boundary to the shell except where a gap exists at the slag discharge opening 86. Apertures in the circular ring 94 are provided at annular spaced locations to receive upstanding locator pins 96 on annular segments at opposite lateral sides of the lower furnace shell 12. These annular ring segments are discontinuous at the slag discharge trough 86 and at a bottom crescent-shaped section protruding in an eccentric fashion from the annular configuration of the overlying upper furnace shell 14. The crescent-shaped bottom section is enclosed by a correspondingly shaped crescent roof section 98. The crescent-shaped roof is formed by a layer of coolant pipes. The crescent-shaped bottom section is used to provide eccentric furnace tapping and is combined with the construction and operation of the lower furnace shell to achieve the benefits of flat bath operation and slag free tapping.

Turning now to FIGS. 4 and 8–13 there is illustrated the configuration of the refractory face surfaces in the lower furnace shell 12 for supporting a metal charge during refining of a steel heat and providing eccentric bottom tapping of the steel heat. As seen in plan view of FIG. 8, there is annular side wall section 100 in an area bounded by a diameter 102 with a radius R1 struck from the center of the diameter 102. As seen in the sectional views of FIGS. 4 and 9, the annular vertical side wall section 100 is bounded by a spherically-dished floor wall section 104 defined by a radius R2 struck form a point along a line defined by intersecting vertical planes 106 and 108 containing the center of the diameter 102. Plane 108 coincides with diameter 102 and plane 106 forms a plane of symmetry of the configuration to the lower furnace shell. A floor wall section 110 begins at vertical plane 108 and proceeds away from the spherically-dished floor wall section 104 by a linear downward-sloping contour along plane 106 with an ever increasing radius RN of curvature transverse to plane 106 forming a rolled developed plate floor wall configuration. The ever increasing radius of transverse curvature of the floor wall section 110 results in an ever increasing height to the vertical side wall 112 as can be seen by from FIGS. 9 and 12. The vertical side wall sections 100 and 112 form a vertical boundary to the liquid metal surface commonly called a hot metal line 114 at the start of tapping a heat. At the conclusion of the tapping of the steel heat, there is a liquid heel line 116 formed by the upper surface of the steel heat and represents a reduction to the liquid metal depth at the diameter 102 typically slightly less than one-half of the depth of the steel heat than at the start of tapping. The downwardly sloping contour of floor wall section 110 along plane 106 and the increasing shallow curvature forming the rolled developed plate floor wall configuration transverse to plane 106 dramatically increases the liquid metal heel line 116. It can be seen from FIG. 9 that the vertical side wall 112 is of maximum height and merges with floor wall section 110 along plane 106 at the site of a tap hole assembly 118. The tap hole has a central vertical axis 120 lying in the vertical plane 106. The central vertical axis 120 also lies in a transverse vertical plane 122 which intersects with plane 106 by a right angle relationship. The furnace of the present invention is operated in a manner to always maintain a liquid heel depth, at the end of tapping, overlying the tap hole of at least three times the diameter of the tap hole during the useful life the tap hole ceramic discs. As shown in FIGS. 8 and 9, the tap hole assembly is formed by a superimposed stack of ceramic disks 124 mounted by a refractory sleeve in the refractory of the floor wall portion 110. A truncated conical tap hole configuration and a correspondingly shaped stopper assembly may be provided according to the disclosure by German Patent No. 198 26 085.

At the conclusion of the tapping of a heat into an underlying ladle 126 supported by a transfer car, one of two tap hole stopper assemblies 128A and 128B is used to fill the tap hole with sand. The provision of two stopper assemblies 128A and 128B enable a quick change over from one assembly to the other as needed. The assemblies 128A and 128B each include a desired quantity of sand in a cardboard sleeve 130 which is inserted vertically into the tap hole with metal support parts being quickly consumed in the liquid metal heel and cardboard being consumed by the thermal temperature, thus releasing the volume of sand directly into the underlying tap hole. The sleeve 130 is lowered by a chain drive 132 mounted on a platform which is pivotal between an inoperative position and an operative positioned established by a stop member. In the operative position the sleeve 130 is lowered by the chain drive through an opening provided access door 134, shown in FIG. 9, in the crescent-shaped roof section 98 along the central vertical axis 120 of the tap hole. After sand replaces the flow of steel emerging from the tap hole, one of two tap hole gates 136A and 136B is positioned by an actuator in a manner per se well known in the art to close off the aperture at the bottom of the tap hole assembly 118. To provide an added measure for failsafe control of the tapping of a heat, an emergency tap hole closure mechanism 138, as shown in FIG. 9 includes a lever arm 140 with a tap hole closure plug 142 at one end and opposite thereto the arm is supported by a pivot shaft 144 secured to spaced apart brackets carried by the outer wall of the lower shell 12. A piston and cylinder assembly 146 is a clevis mounted to the outer wall of the shell for pivotally displacing the closure mechanism 138 from a stand by position to a closure position. In the closure position, closure plug 142 seals off the tap hole with a sufficient force exerted by the piston and cylinder assembly to maintain the seal against the ferrostatic head.

Figure 11:
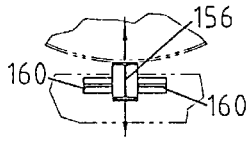
FIG. 11 is a plan view of the structure shown in FIG. 11.
Figure 10:
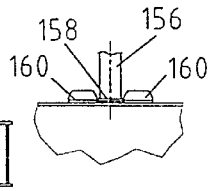
FIG. 10 is a fragmentary elevational view taken along lines X—X of FIG. 8 showing furnace position structure.

The electric arc furnace 10 is statically supported continuously throughout repeated charging and tapping of heats and this feature of the present invention is utilized to maintain the central vertical axis 120 of the tap hole constant by the provision of furnace locator guide assemblies 148, 150, 152 and 154 which confine horizontal movement of the lower shell due to thermal expansions to only within vertical planes that intersect at the site of the central vertical axis 120 of the tap hole. The provision of the furnace locator guide assemblies maintains the tap hole at the same location so that the underlying ladle 126 receives taped heats repeatedly at the same location. The furnace locator guide assemblies also allow the cardboard sleeve 130 to be reliably lowered into the metal bath consistently along the central vertical axis 120 of the tap hole. The furnace locator guide assemblies 148, 150, 152 and 154 each embody the same construction of parts which as shown in FIGS. 10 and 11 include a vertically arranged beam 156 secured to a lower shell 12 with a rectangular shoe plate 158 fitted for only linear sliding movement in a gap between spaced apart guide bars 160. The guide bars 160 for each furnace locator guide assembly are secured to a support beam 162 forming part of a furnace support frame 164. The furnace locator guide assemblies 148 and 150 cooperate to confine thermal expansion of the lower furnace shell 12 to the transverse vertical plane 122 by allowing only linear sliding movement of the rectangular shoe plates 158 between the guide bars 160 along the transverse vertical plane 122 which passes through the central vertical axis 120 of the tap hole. The furnace locator guide assemblies 152 and 154 cooperate to confine thermal expansion of the lower furnace shell 12 to the vertical plane 106 by allowing only linear sliding movement of the rectangular shoe plates 158 between the guide bars 160 along the vertical plane 106 which passes through the central vertical axis 120 of the tap hole. By this strategic location of the furnace locator guide assemblies, thermal changes to the lower furnace shell take place without altering the site of the central vertical axis of the tap hole.

Figure 2:
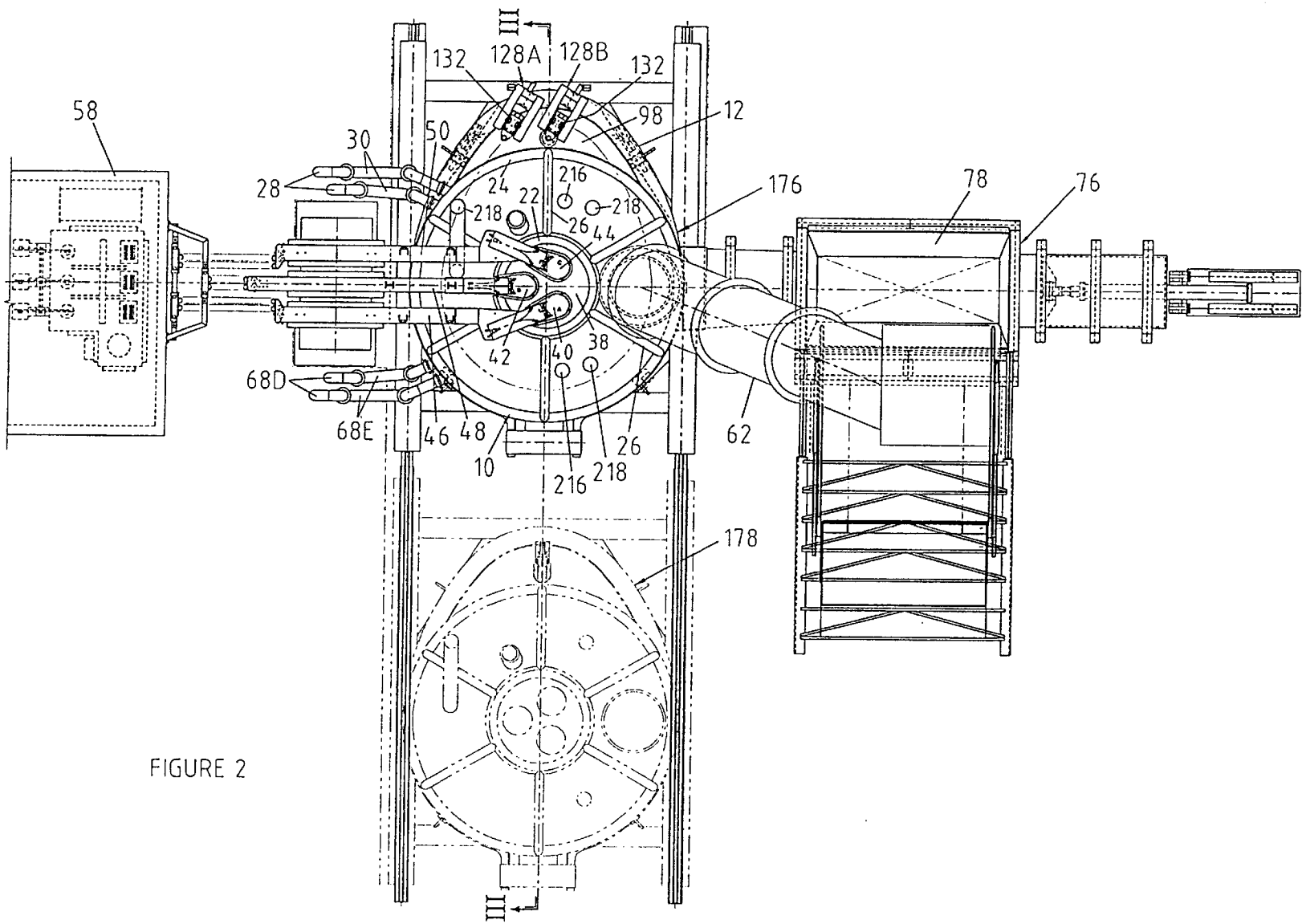
FIG. 2 is a plan view of the electric arc furnace installation shown in FIG. 1.
Figure 3:
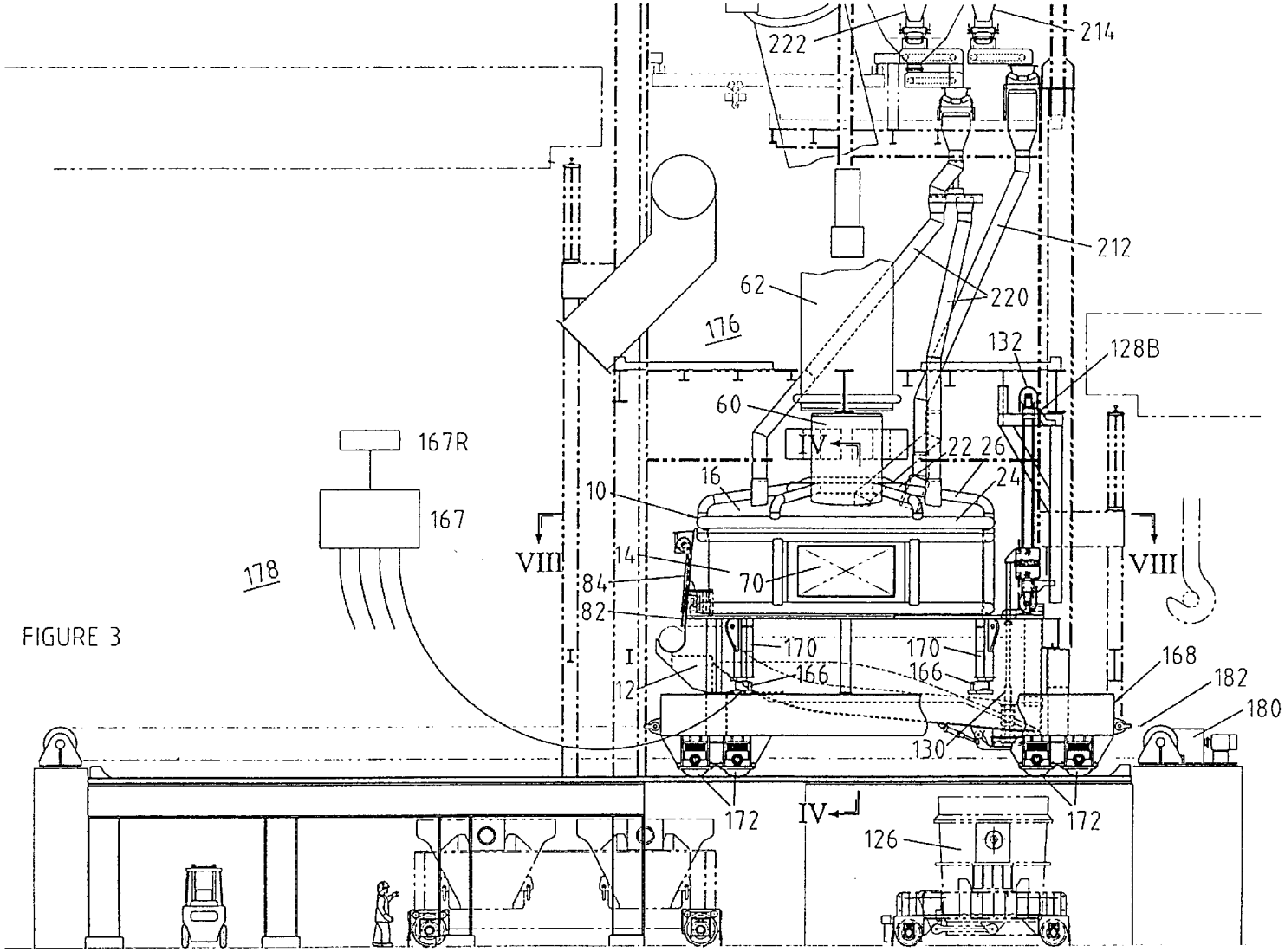
FIG. 3 is a side elevational view of the electric arc furnace illustrated in FIG. 1.
Figures 6, 7:
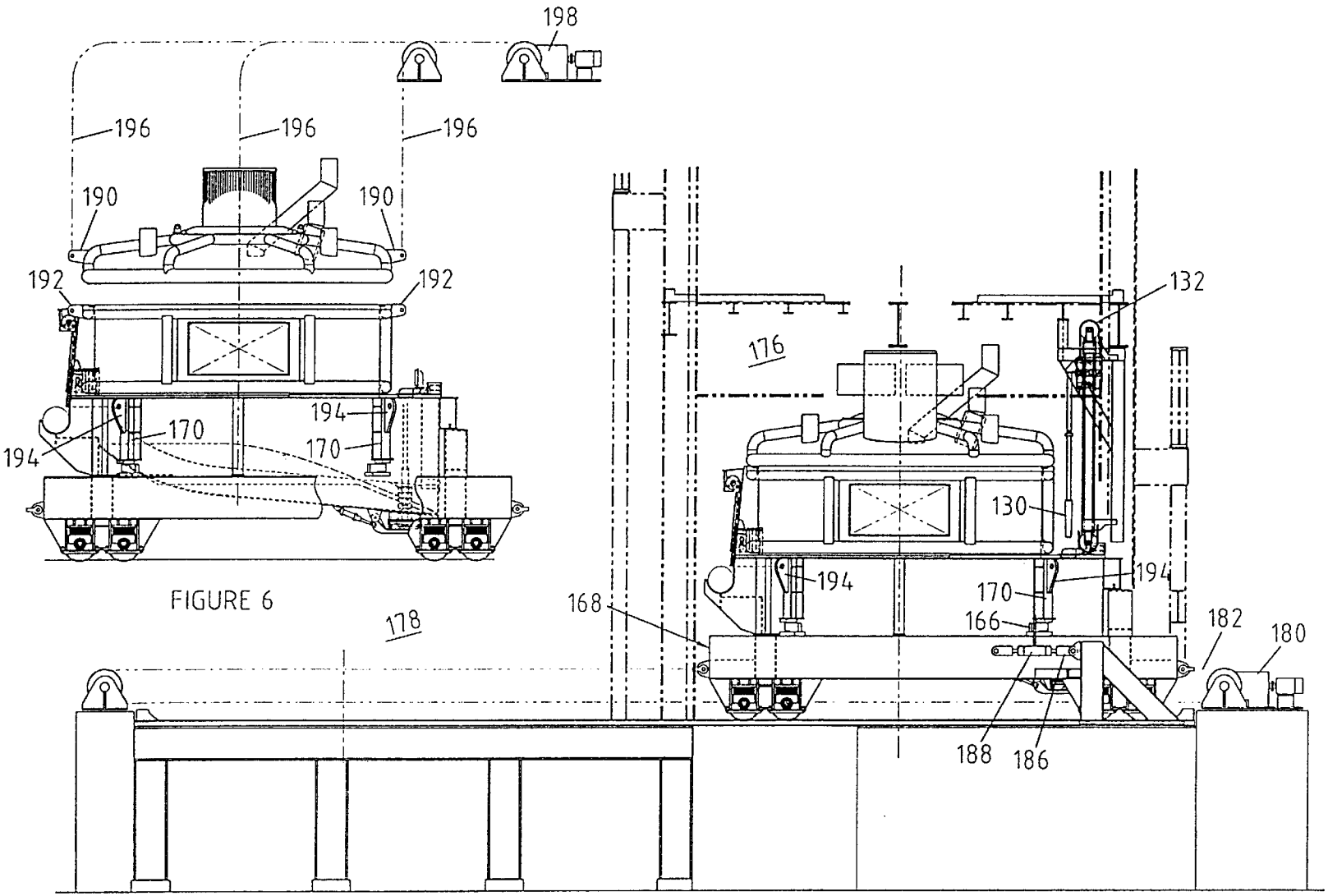
FIG. 6 is a fragmentary view similar to FIG. 5 illustrating suspension of each of the furnace roof and an upper shell for servicing of the at the lateral side of the furnace operating position.
FIG. 7 is an elevational view of electric arc furnace transfer car showing the drive and anchoring mechanism for controlling movement of the furnace between an operating position and an exchange position.

An important feature of the present invention resides in the maintenance of a large heel after tapping a heat to facilitate the flat bath and slag free tapping operations of the furnace. Control elements for the operation of the furnace include the provision of a load cell 166 at each of a load transfer support site for the lower furnace shell 12 on a furnace support frame 164 which in the preferred embodiment of the present invention forms part of a furnace transfer car 168. The support relationship between the lower furnace shell and the furnace car is shown in FIGS. 1–3 and includes struts 170 joined to a vertical side wall of the lower shell. The strut is in load bearing contact with a load cell 166 mounted on the support beam 162 extending diagonally between side beams and end beams comprising the furnace support frame 164. The furnace transfer car 168 is supported by wheels 172 for movement in a direction parallel to vertical plane 106 upon spaced apart rails 174 between a furnace operating position 176 as shown in FIGS. 2 and 3 and a furnace component exchange position 178. Bearings at opposite sides of each wheel provide rotatable support for the wheels. A winch 180 is provided with a cable 182 extending between spaced apart pulleys 184 and the ends of the cable connected to the end beams of the furnace support frame 164. As shown in FIG. 7, the furnace car is anchored against stops 186 by ratchet binders 188. The rails 174 are supported on spaced apart foundations that have an extended height that is sufficient to allow passage of a ladle 126 by a transfer car.

Figure 5:
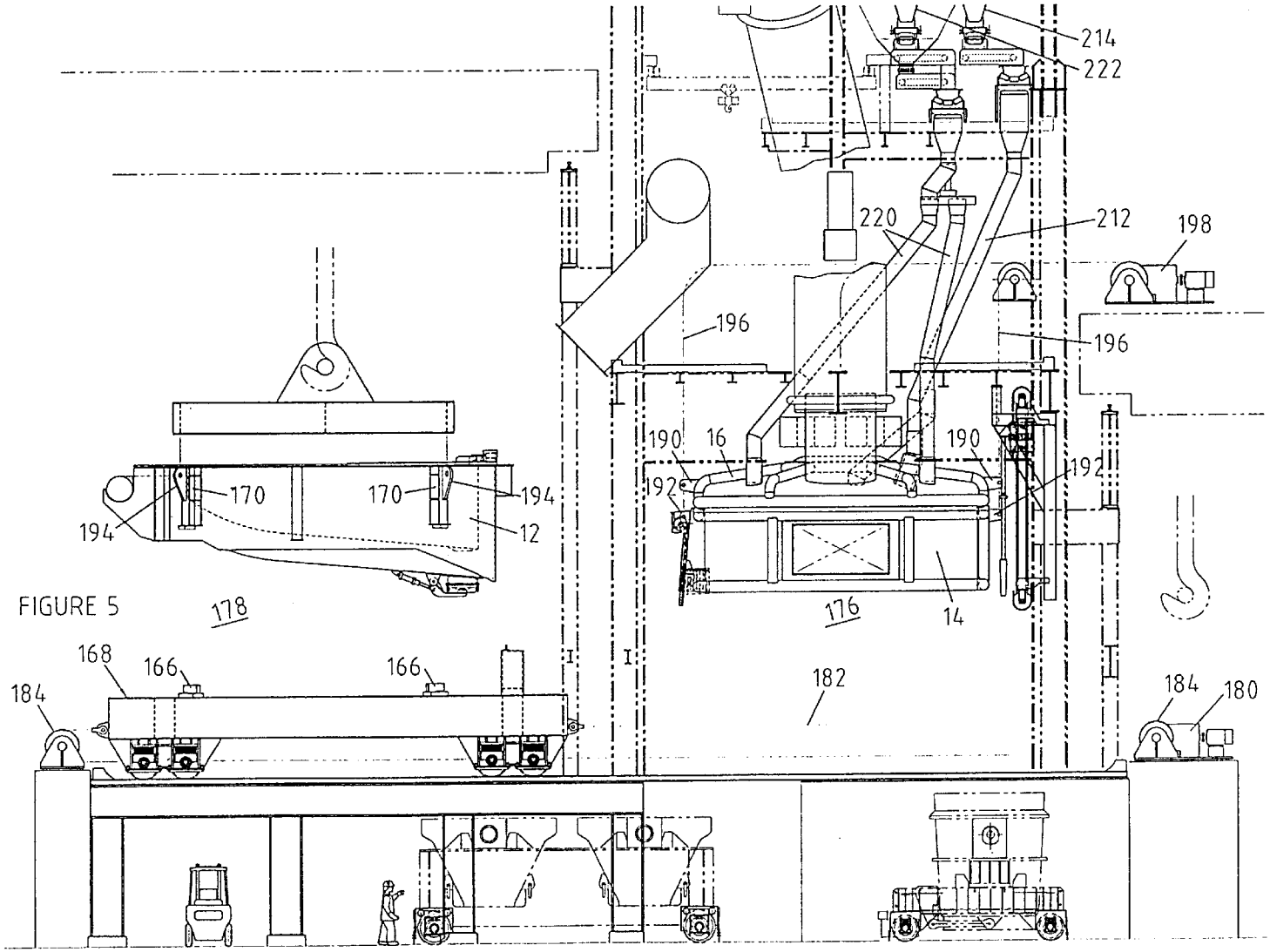
FIG. 5 is a side elevational view similar to FIG. 3 and illustrating the suspension of the roof component for servicing of underlying furnace components at a lateral side of the furnace operating position.

Referring to FIGS. 5, 6 and 7, the furnace roof 16, upper furnace shell 14 and lower furnace shell 12 will require periodic repairs but at widely varying time intervals. For example, it is likely that the bottom furnace shell will require repair of the refractory and relining of the refractory more frequently than the need to repair the furnace roof and upper furnace shell. The downtime of the furnace is an important economic factor and to minimize the downtime, the furnace roof is provided with lifting lugs 190 at spaced apart intervals about the upper periphery. The upper furnace shell is provided with lifting lugs 192 at spaced apart intervals about the upper periphery thereof The lower furnace shell is provided with lifting lugs 194 secured to the upper parts of the struts 170. When it is necessary to service the lower furnace shell, the coolant supplies provided by service lines 28 and 68D for the furnace roof and the upper furnace shell are turned off but the supply lines remain connected. The scrap charging chute 74 is retracted from charging opening 70 in the upper furnace shell. Strands of wire rope 196 are paid out from spools operated by a winch drive 198. Each wire rope is secured to an upper shell lifting lug 192 and then the winch drivel 98 is operated to lift the upper furnace shell 14 and the furnace roof 16 as a unit and a distance sufficient to allow movement of the furnace transfer car 168 and lower furnace shell 12 from the operating position 176 to the furnace component exchange position 178. It is typical to lift these components of an electric arc furnace constructed to produce a 360T heat at the start for tapping a distance of about 2.0 feet.

After the lower shell is removed from the furnace transfer car 168 at the furnace component exchange position 178, a replacement lower shell is seated in position with the struts 170 resting on the load cells 166 which is facilitated by seating of the shoe plates 158 between the spaced apart guide bars 160. The furnace transfer car is then returned to the operating position 176 by operation of the winch 180. The rachet binders 188 are then used to draw the car against the stop 186. The upper furnace shell and furnace roof can then be lowered for support on the lower furnace shell. The electrodes 40, 42 and 44 and retractable chutes 74 are the placed in their operative position and the furnace is ready to resume operation. When the upper furnace shell must be serviced, then only the furnace roof 16 is lifted the same distance of about 2.0 feet by use of the wire ropes 196 connected to the roof lifting lugs 190 and winch 198 is operated. It is necessary however, to disconnect the coolant supply provided by service lines 68D for the water from the upper furnace shell 14 and withdraw the electrodes and charging chute to their remote positions. The furnace transfer car is then used to transport the upper furnace shell while seated on the lower furnace shell to the furnace component exchange position 178 and then return the replacement upper furnace shell operatively seated on the lower furnace shell to the furnace operative position 176. The water service, electrodes and charging chutes are then moved to reestablish their respective operating positions. After the furnace transfer car is drawn against the stop by ratchet binders 188, furnace operation can be resumed. When the entire furnace, only the furnace roof or the furnace roof and the upper shell and/or the lower shell require service, then the entire furnace is transferred by the furnace transfer car to the furnace component exchange position 178 and a reassembled furnace on the furnace transfer car is returned to the furnace operating position 176. These usages of the furnace transfer car allow the use of mill cranes to transfer large furnace components without obstruction due to facilities associated with the operation of the furnace such as the fume duct, electrodes and scrap charging.

Figure 14:
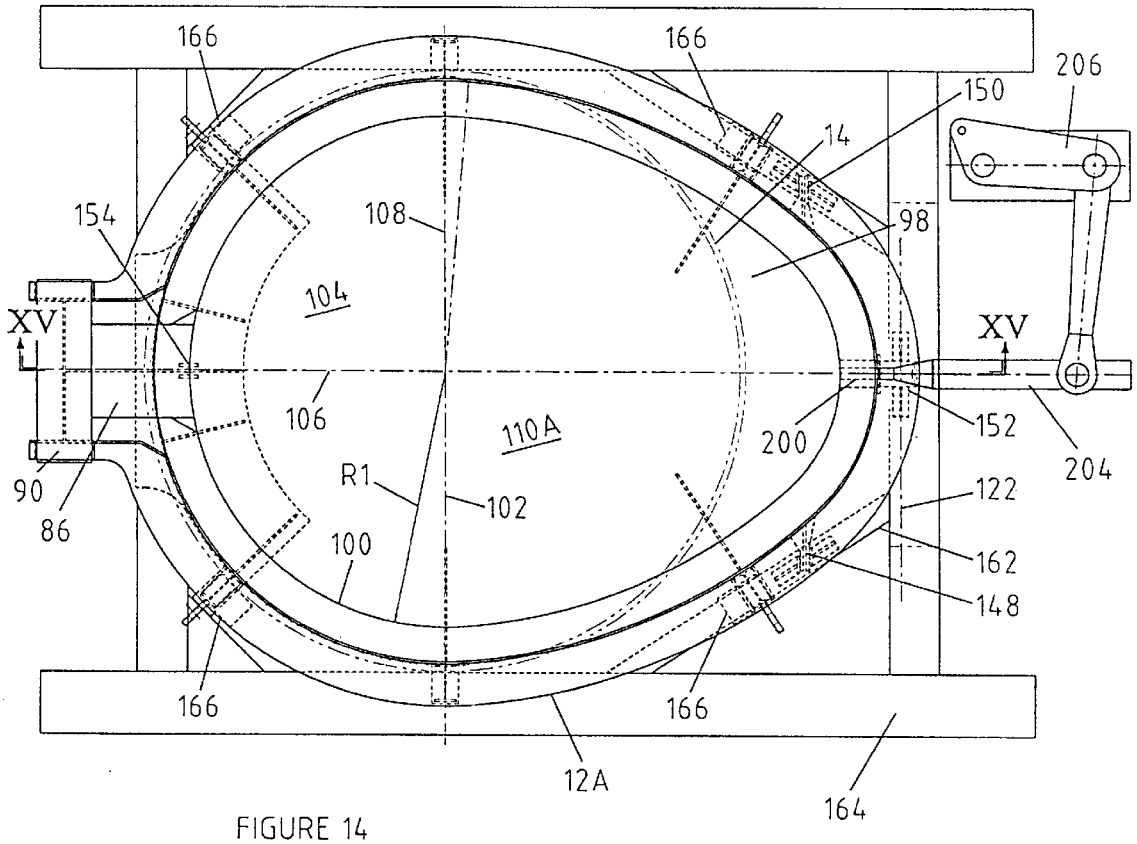
FIG. 14 is a plan view of a modified location of a tap hole in the lower shell of the furnace shown in FIG. 1.
Figure 15:
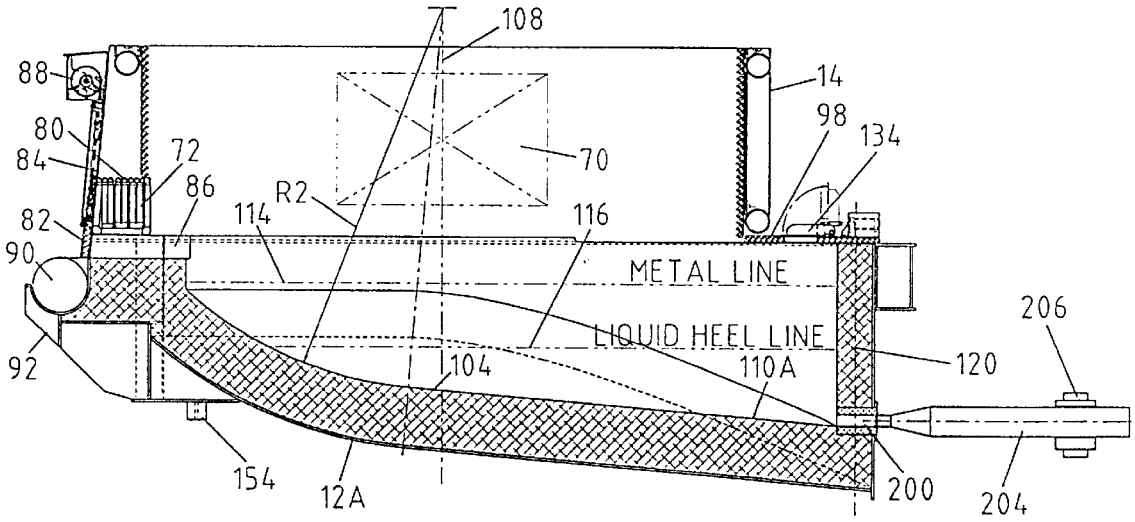
FIG. 15 is a sectional view taken along lines XV—XV of FIG. 14.

FIGS. 14 and 15 illustrate a modified arrangement of a tap hole for the electric arc furnace featuring eccentric furnace tapping described and shown in FIGS. 1–13 according to this present invention. A tap hole insert 200 includes ceramic disks arranged in a face to face relation and mounted in the vertical side wall 112A such that the bottom edge of the liquid steel conducting opening 202 forms an extension to the floor wall section 110A and thereby promote slag free tapping by maintaining a ferrostatic head above the tap hole insert 200 of at least three times the diameter of the tap hole. Sanding of the tap hole to seal off the liquid metal flow at the conclusion of tapping as replaced by a conventional tap hole clay gun and drill assembly 204 moved into an operative position by lever arms 206 by a piston and cylinder assembly, not shown. The door 134 in the crescent shaped roof section 98 can be eliminated. The locations of the tap hole location guide assemblies 148 and 150 are changed to sites underlying the vertical side wall 112A at opposites lateral sides of the tap hole insert 200 which causes a relocation of the transverse vertical plane 122 but no change to the vertical plane 106. The central vertical axis 120 is located midway along the horizontal length of the tap hole insert 200. The tap hole location guide assemblies 154 and 154 are unchanged from their location shown in FIG. 8.

Figure 18:
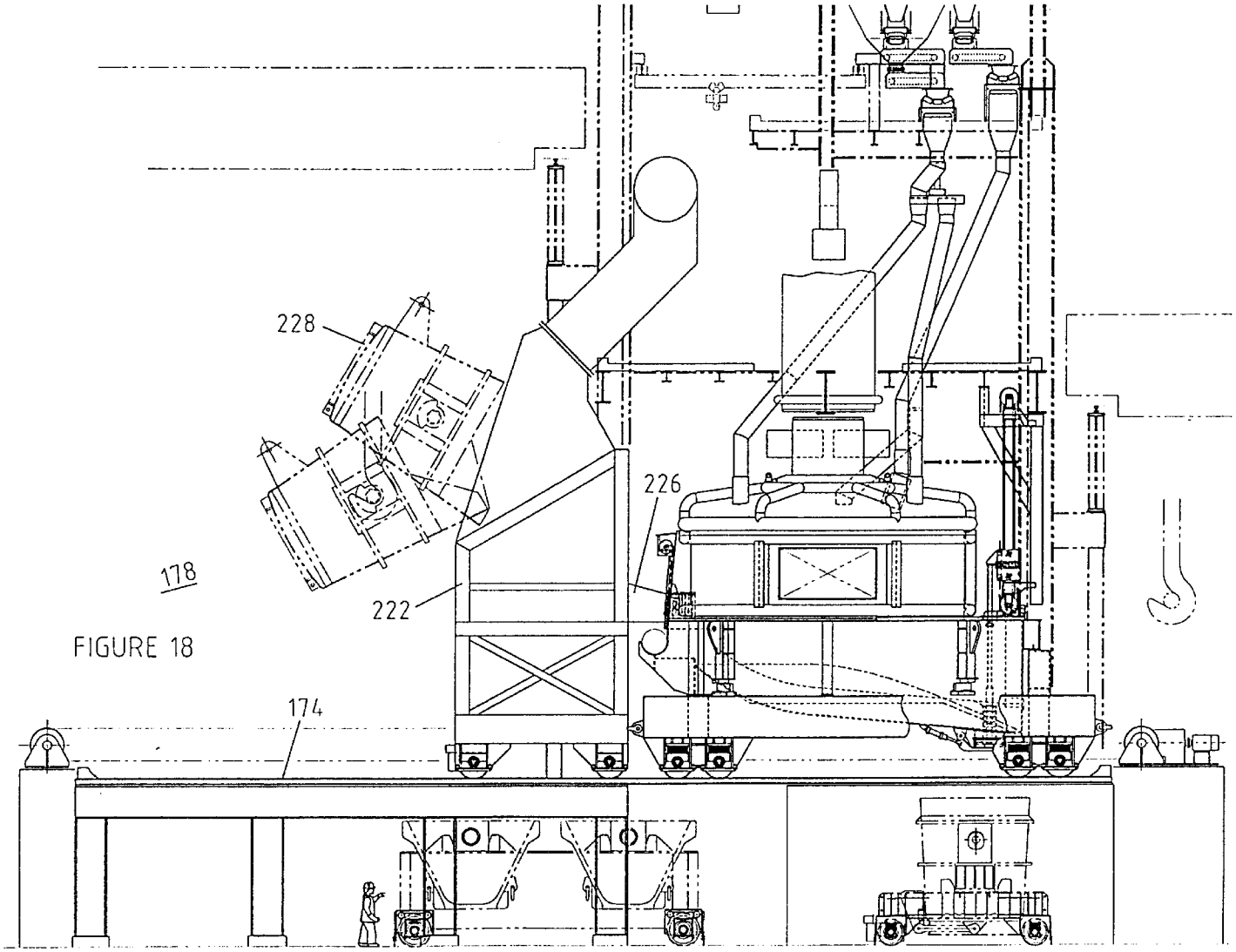
FIG. 18 is a side elevational view similar to FIG. 3 and illustrating the addition of a pouring tundish for introducing a charge of liquid metal in the electric arc furnace.
Figure 19:
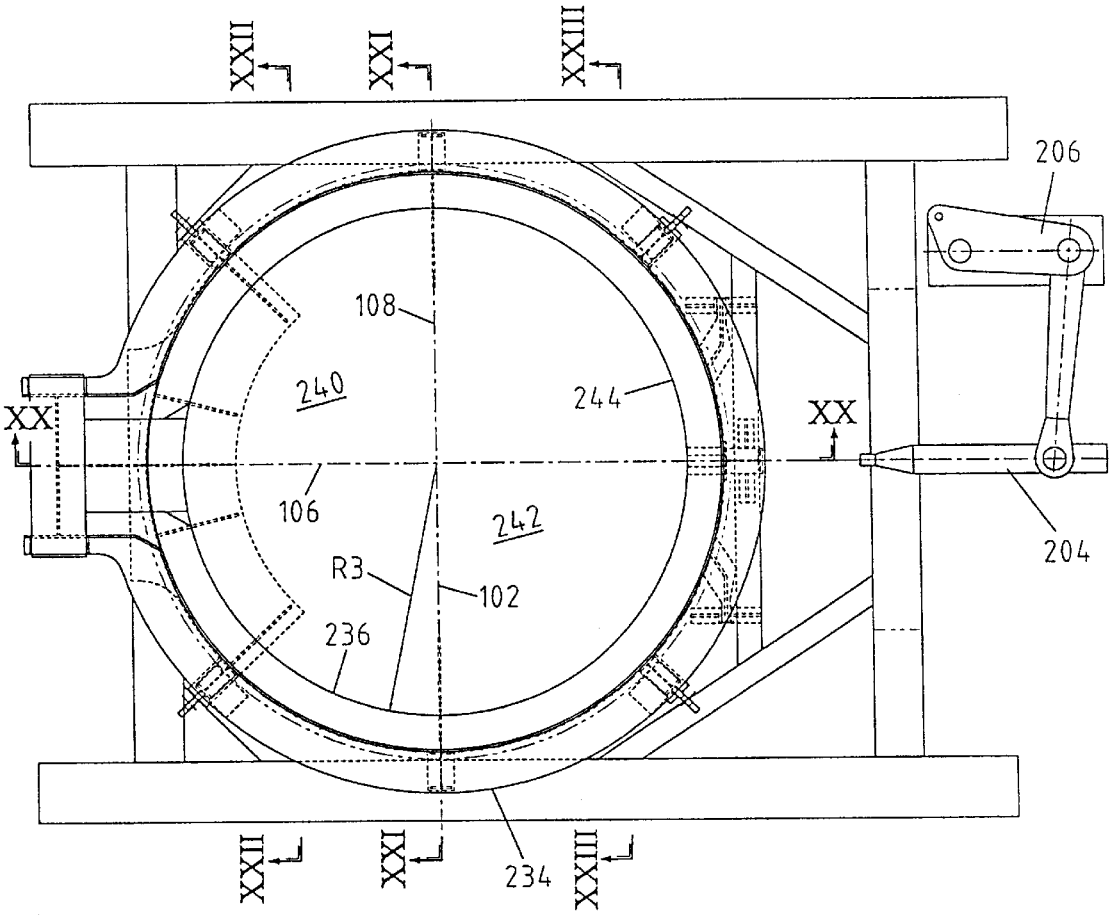
FIG. 19 is a plan view of a lower shell according the a second embodiment of the present invention.
Figure 20:
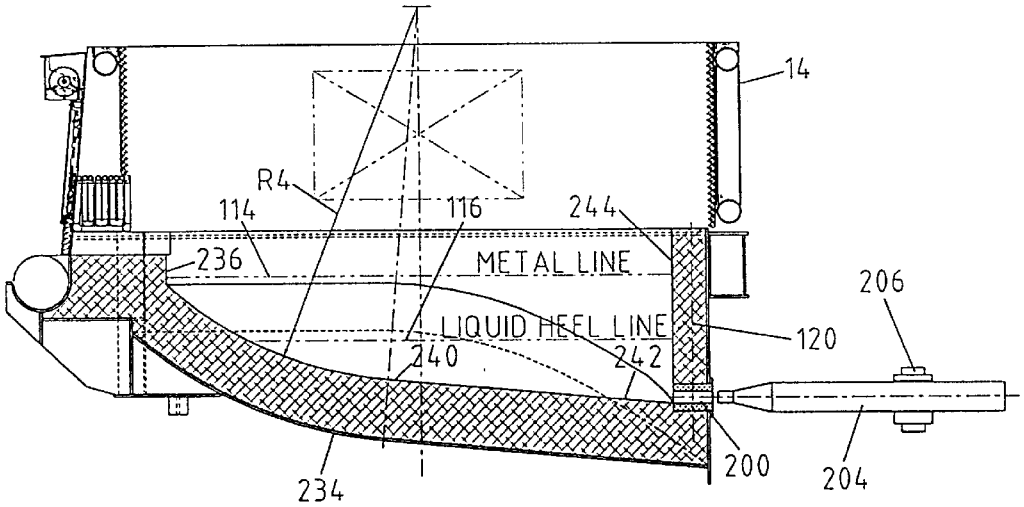
FIG. 20 is a sectional view taken along lines XX—XX of FIG. 19.
Figure 21:
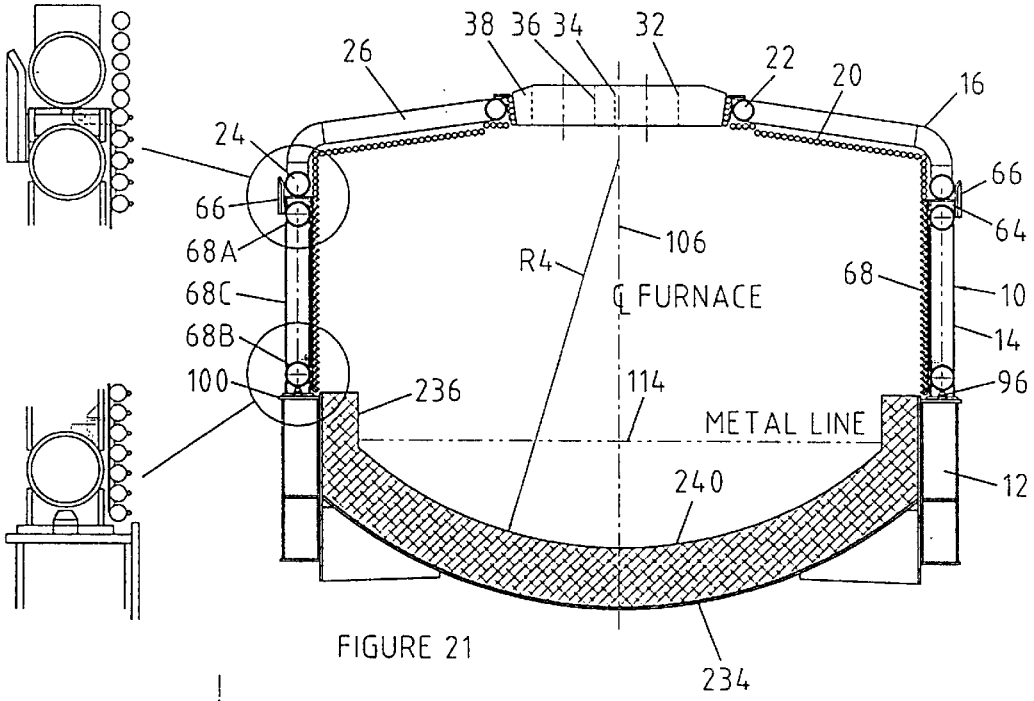
FIG. 21 is a sectional view taken along lines XXI—XXI of FIG. 19.
Figure 23:
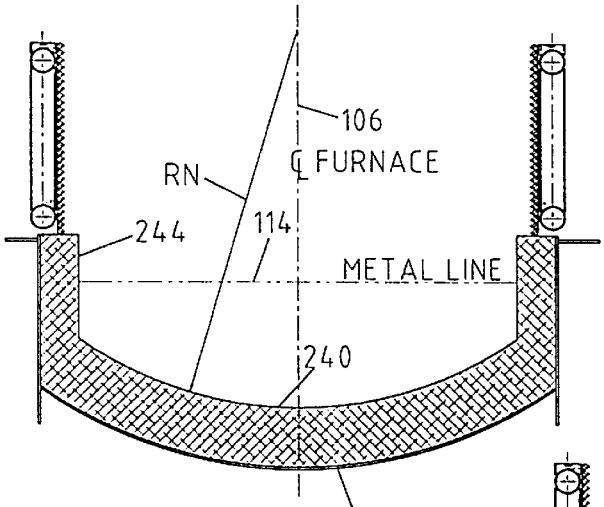
FIG. 23 is a sectional view taken along lines XXIII—XXIII of FIG. 19.
Figure 22:
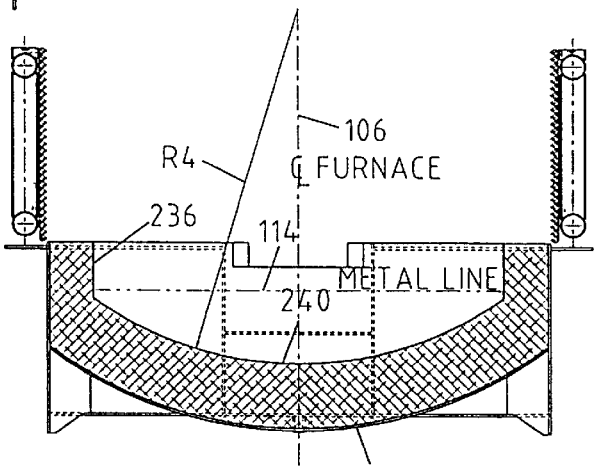
FIG. 22 is a sectional view taken along lines XXII—XXII of FIG. 19.

The electric arc furnace of the present invention offers versatility to the steel making operation. The furnace charging material for the most common steel making operation will be scrap which is preferable continuously introduced at closely spaced time increments as explained previously. In addition to the charging of the furnace with scrap, direct reduction iron may be introduced to an opening 210, shown in FIG. 2, in the roof insert 38 by a chute 212 extending from a DRI storage hopper 214 as best shown in FIG. 18. The chute 212 is arranged at an angular relation to the vertical so that the DRI impacts with the metal bath at a site proximate to the triangular array of electrodes to take advantage of the highly heated area in the metal bath for rapidly melting the pellets of DRI material. There are additional openings 216 and 218 in the furnace roof Openings 216 are used to insert carbon/oxygen lances, not shown, for slag foaming operation. Openings 218 communicate with chutes 220 extending to a plurality of flux and carbon bins 222 for introducing fluxing and carbon materials. Liquid metal may also form a furnace charge or a part thereof. Typically, the liquid metal will comprise blast furnace iron. As shown in FIG. 18 there is provided a pouring tundish 224 with wheels arranged for supporting the tundish on the rails 174. The tundish includes a launder 226 arranged to allow the introduction of liquid metal through openings formed by the slag discharge trough 86. A ladle 228 is moved to the furnace exchange area 178 for introducing liquid metal to the tundish.

Figure 16:
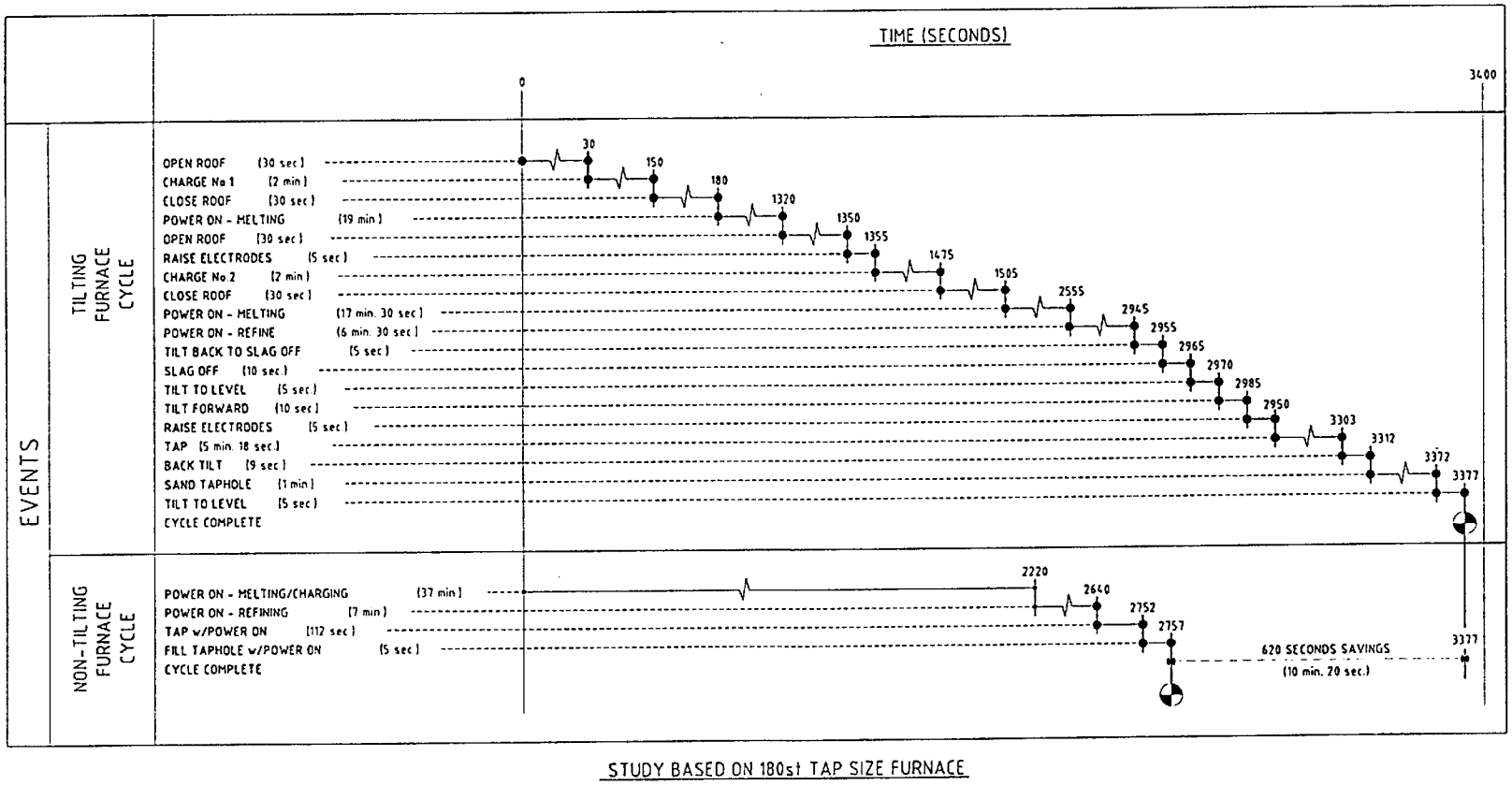
FIG. 16 is a furnace cycle comparison between a tilting electric arc furnace and an electric arc furnace according to the present invention.

The operation of the furnace according to the present invention provides a larger tonnage output at a shorter furnace operating cycle. FIGS. 16 and 17 illustrate a cycle time comparison between a standard tilting electric arc furnace and an electric arc furnace according to the present invention. The study demonstrates a time savings of 10 minutes 20 seconds per furnace cycle. There are two factors contributing to this time savings. The one factor is the size of the liquid metal heel provided by the configuration of the liquid metal cavity in the refractory of the lower shell. The heel after tapping is at least 70% preferably 100% of the heat before tapping which provides a substantial thermal benefit after tapping to maintain flat bath operation throughout the charging of scrap and/or other forms for charging material as identified hereinbefore. Melting a newly introduced scrap charge combined with the introduction of heat by operation of electrodes continues throughout the charging of the furnace. FIG. 3 further illustrates the use of a control 167 typically located in an operator pulpit and having a summation circuit receiving input signals from the load cells 166 and providing an electrical signal corresponding to the weight of the furnace including the liquid metal heat which is modified by a signal to provide an output signal representing only the weight of the liquid metal heat. The weight of the liquid metal heat may be displayed in any convenient way such as a numerical read out 167R. The read out will be used to control the furnace operation including start and stop of charging and tapping.

The size of a heel provides the further benefit of prolonging the life of the refractory by reducing the magnitude of the temperature fluctuations of the refractory during each cycle. Mechanical shock due to tilting of the furnace in opposite directions for tapping and slag off is eliminated throughout the furnace operation cycle. The feature of operating the furnace while completely static, serves also to shorten the operating cycle time by allowing power on the electrodes throughout tapping, slagging and charging which is not possible in the operation of a tilting furnace. Additionally cost savings occur in furnace operation according to the present invention due to the elimination of burners which are required in the operation of the tilting furnace cycle to equalize the temperature in the furnace. In tilting furnaces cold spots develop during the melting phase of a scrap charge and must be eliminated by the use of the burners. Another factor contributing to the time saving arising out of the present invention is the time needed to tap a heat. In the comparison given in FIG. 17, the time to tap a heat producing 180 tons of liquid metal in a ladle according to the present invention is 117 seconds less than 2 minutes using a new 9 inch diameter tap hole. This tapping operation is accomplished with the aid of a ferrostatic head of at least 3 times the tap hole diameter at the end of a tap formed by the large ferrostatic head of 180 tons of liquid metal remaining in the furnace at the conclusion of the tapping operation. In the example of FIG. 17, it is assumed a new 9 inch diameter tap hole which calls for a 36-inch ferrostatic head along the overlying the tap hole to accommodate enlargement of the tap hole due to erosion. Additionally the 36 inches of ferrostatic head guarantees slag free tapping even with a worn tap hole. Sanding of the tap hole consumes only 5 seconds. In a tilting furnace, the tap hole can be 6–10 inches. The times to lift electrodes, tilt to slag off, tilt to effect tapping and plug the tap hole requires about 7½ minutes. These time comparisons for tapping will change with an increase to the tap hole size due to erosion by the tapped heat but the time saving will remain essentially the same height of the ferrostatic head formed by the heel will remain sufficient to always maintain the ferrostatic head of at least three times the diameter tap hole throughout enlargements due to erosion to guarantee slag free tapping.

In the time study comparison given in FIG. 16, the non tilting furnace cycle of the present invention uses a liquid metal hot heel of 100% of the heat at the start of tapping which is advantageous by providing a full heat when it is desired to completely drain the furnace. The thermal inertia provided by the liquid metal hot heel to the refining process is sufficient in the present invention when the heel is 70% of the heat at the start of tapping which is sufficient to provide the necessary thermal inertia of a rapid melt down of a furnace charge and provide the additional benefit of increasing the furnace efficiency including lower electrical costs. The known practice of maintaining a heel is limited to a very small percentage of the heat usually 20 to 40% and is ineffective for maintaining flat bath operation throughout the refining period of the heat by the furnace. Additionally, 20 to 40% of the heat after tapping is an insufficient volume to maintain slag free tapping of a furnace remaining static throughout its operating cycles. Reduction of the furnace cycle time reduces the time the hot metal stream of the tapped heat can entrain nitrogen and also reduces the time the tapped heat spends in the ladle which decreases the temperature loss of the tapped steel in the ladle according to the present invention. The higher temperature of the steel in the ladle is especially beneficial for its use as a hot metal As shown in FIGS. 19–23 the present invention is applied to a furnace having a wholly circular vertical side wall section in a lower shell 234. The configuration of the refractory face surfaces in the lower furnace shell 234 as seen in plan view of FIG. 19 include annular side wall section 236 in an area bounded by a diameter 238 with a radius R3 struck from the center of the diameter 102. As seen in the sectional views of FIGS. 21 and 22, the annular vertical side wall section 238 is bounded by a spherically-dished floor wall section 240 defined by a radius R4 struck form a point along a line defined by intersecting vertical planes 106 and 108 containing the center of the diameter 102. Plane 108 coincides with diameter 102 and plane 106 forms a plane of symmetry of the configuration to the lower furnace shell. A floor wall section 242 begins at vertical plane 108 and proceeds away from the spherically-dished floor wall section 104 by a linear downward-sloping contour along plane 106 and an ever increasing radius RN of curvature transverse to plane 106 forming a rolled developed plate floor wall configuration. The ever increasing radius of transverse curvature of the floor wall section 2421 results in an ever increasing height to the vertical side wall 244 as can be seen by from FIGS. 23 and 24. The vertical side walls 238 and 244 forms a vertical boundary to the liquid metal surface commonly called a hot metal line 114 at the start of tapping a heat. At the conclusion of the tapping of the steel heat, there is a liquid heel line 116 formed by the upper surface of the steel heat and represents a reduction to the liquid metal depth at the diameter 102 typically slightly less than one-half of the depth of the steel heat than at the start of tapping. The downwardly sloping contour of floor wall section 242 along plane 106 and the increasing shallow curvature transverse to plane 106 forms a dramatic increase to the depth liquid heel line 116. It can be seen from FIG. 20 that the vertical side wall 244 is of maximum height and merges with floor wall section 242 along plane 106 at the site of a tap hole assembly 200. The tap hole is constructed and arranged as shown and described in FIGS. 14 and 15. As in all embodiments described in hereinbefore, the furnace of the present invention is operated in a manner to always maintain a liquid heel depth overlying the tap hole, at the end of tapping, of at least three times the diameter of the tap hole during the useful life the tap hole ceramic discs.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electric furnace for steel making, said furnace including the combination of:

a lower furnace shell stationarily supported during charging of a heat, heating of said heat and tapping of said heat, said lower shell having a floor wall with a sloping contour to increase a liquid metal depth to at least three times the diameter of a tap hole at a site communicating with the tap hole for slag free tapping of said heat, said lower furnace shell having a liquid metal capacity to maintain a liquid metal heel of at least 70% of said heat before tapping for flat bath refining of said heat throughout said charging and heating of said heat;

an upper furnace shell supported by said lower furnace shell;

a furnace roof supported by said upper furnace shell;

an electrically powered member for heating a metal charge in said lower furnace shell; and a control including plugging for said tap hole to control tapping of said heat form said lower furnace shell.

2. The electric furnace according to claim 1 wherein said lower furnace shell includes a vertical annular side wall section with a uniform height extending to side wall sections of ever increasing vertical heights joining at a junction with said floor wall at the site of said tap hole.

3. The electric furnace according to claim 2 wherein said side wall sections of ever increasing vertical heights join with said floor wall in a crescent shaped area forming a protrusion extending beyond said upper furnace shell for extending bottom tapping.

4. The electric furnace according to claim 3 further including a crescent shaped furnace roof section for enclosing said crescent shaped area; and a door for normally closing an access opening and wherein said tap hole is located in said floor wall and; wherein said control including plugging includes a tap hole stopper moveable through said access opening for communicating with said tap hole.

5. The electric furnace according to claim 3 further including a crescent shaped furnace roof section for enclosing said crescent shaped area; and wherein said control including plugging includes a tap hole drill and a clay gun.

6. The electric furnace according to claim 1 where said furnace roof includes an aperture; and wherein said electric furnace further includes an electrode passed through said aperture for delivering electric current to heat a metal charge in said lower furnace shell.

7. The electric furnace according to claim 1 further including support tackle for lifting and supporting one or both of said furnace roof and upper furnace shell to a predetermined elevation sufficient to allow horizontal displacement of at least said lower furnace shell or said lower furnace shell and said upper furnace shell to a remote furnace exchanging position without by said furnace roof.

8. The electric furnace according to claim 4 wherein said roof has a fume opening and wherein said furnace further includes a cooling duct for receiving exhaust fume emitted from the fume opening in said roof.

9. The electric furnace according to claim 2 wherein said lower shell includes a refractory lining continuously sloping downwardly from a vertical side wall opposite said tap hole to said side wall sections of ever increasing vertical heights proximate to said tap hole defining a maximum ferrostatic head of liquid steel at said tap hole.

10. The electric furnace according to claim 1 further including a furnace transfer car supporting said lower furnace shell, rails supporting said furnace transfer car on superstructure for movement between a furnace operating position and a furnace exchange position; and a drive for linearly displacing said furnace transfer car along said rails between the furnace operating position and the furnace exchange position; and an anchor to secure said furnace transfer car at said furnace operating position.

11. The electric arc furnace according to claim 1 further including a plurality of anchor members for controlling said lower furnace shell due to thermal expansion thereof, wherein said tap hole is defined at the intersection of perpendicular vertical planes, said tap hole lying between spaced apart anchor members within each of said vertical planes, said allowing thermal expansion of said lower furnace shell within the vertical plane, thereof and excluding movement of the lower furnace shell perpendicularly thereto and thereby prevent movement of the tap hole from the intersection of said perpendicular vertical planes.

12. An electric furnace for steel making, said furnace including a combination of:

a furnace transfer car;

a drive for linearly displacing said furnace transfer car along rails between a furnace operating position and a furnace exchange position;

an anchor to secure said furnace transfer car at said furnace operating position;

a lower furnace shell supported by said furnace transfer car, said lower furnace shell having a floor with a sloping contour to form an area of every increasing liquid metal depth, the sloping contour of the floor forming a maximum metal bath depth proximate a tap hole for discharging a heat treated in the furnace;

an upper shell furnace supported by said furnace lower shell;

a furnace roof supported by said upper furnace shell;

said furnace roof including apertures for electrodes and exhaust of fume from the interior of the furnace;

electrodes extending through apertures through said furnace roof for heating said heat in said lower furnace shell;

a control including plugging for said tap hole to control tapping of said heat said lower furnace shell;

a cooling duct for receiving exhaust fume emitted from, an aperture in said furnace roof; and members for supporting said furnace roof or said furnace roof and said upper furnace shell at said furnace operating position to allow removal of said lower furnace shell and upper furnace shell or said furnace lower shell to said furnace exchange position.

13. The electric arc furnace according to claim 12 further including a plurality of anchor members each having components supported by each of said furnace car and said lower furnace shell for controlling said lower furnace shell due to thermal expansion thereof, wherein said tap hole is defined at the intersection of perpendicular vertical plies, said tap hole lying between spaced apart anchor members within each of said vertical planes, said anchor members allowing thermal expansion of said lower furnace shell within the vertical plane thereof and excluding movement of the lower furnace shell perpendicularly thereto and thereby prevent movement of the tap hole from the intersection of said perpendicular vertical planes.

14. A method for producing steel in an electric furnace, said method of including the steps of:

providing an electric furnace including a lower furnace shell having a sloping floor extending downwardly to a tap hole;

refining a steel melt in said furnace using electric current to form a first heat;

tapping a sufficient quantity of steel from said first heat to a ladle while said lower furnace shell remains stationary to maintain a liquid hot heel in said furnace consisting of at least 70% of the tapped steel;

maintaining flat bath furnace operation by using electric current and latent heat of said liquid hot heel to refine charged material in said furnace for forming a second heat; and tapping a sufficient quantity of steel from said second heat while said lower furnace shell remains stationary to maintain a liquid hot heel in said furnace consisting of at least 70% of the tapped steel.

15. The method for producing steel in an electric furnace according to claim 14 including the further step of locating said tap hole relative to said sloping floor to define a ferrostatic head of the liquid steel at said tap hole of at least three times the diameter of said tap hole including wear of said tap holed at the end of tapping.

16. The method for producing steel in an electric furnace according to claim 14 including the further step of selecting a furnace transfer car movable to a furnace exchange position from a furnace operating position; anchoring the furnace transfer car at the furnace operating position during said step of refining a steel melt in said furnace; and using the furnace transfer car to transfer said lower furnace shell for servicing at said furnace exchange position.

17. The method for producing steel in an electric furnace according to claim 14 including the further step of confining said lower furnace shell to movements along perpendicularly intersection vertical planes forming a vertical axis containing said tap hole to constrain said lower furnace shell to thermal expansion within said vertical planes and maintain the site as said tap hole constant.

18. The method for producing steel in an electric furnace according to claim 14 wherein said step of providing an electric furnace further includes arranging three electrodes for conducting respective phases of three phase electric current in an upper furnace shell through a furnace roof for heating a metal charge in said lower furnace shell.

19. The method for producing steel in an electric furnace according to claim 14 wherein said liquid hot heel is 100% of the tapped steel.

20. The method for producing steel in an electric furnace according to claim 14 wherein said using electric current to form a first heat further includes continuously supplying electric current to heat liquid metal in the furnace during said step of tapping.

21. The method for producing steel in an electric furnace according to claim 14 including the further step of continuously charging material during intermittent time intervals substantially throughout said step of maintaining flat bath furnace operation.

22. The method for producing steel in an electric furnace according to claim 21 including the further step of terminating said step of continuously charging material before said step of tapping.

23. The method for producing steel in an electric furnace according to claim 14 wherein said step of providing an electric furnace further include providing an upper furnace shell and a roof therefor, said upper furnace shell have annular side walls supported by said lower furnace shell and forming an extended part of said lower furnace shell for extended bottom tapping of a heat.

* * * * *